United States Patent [19]

Wood

[11] Patent Number: 4,625,345

[45] Date of Patent: Dec. 2, 1986

[54] AUTOMATED SOFA BED

[76] Inventor: Lorin A. Wood, 19422 Palo Verde Dr., Sun City, Ariz. 85372

[21] Appl. No.: 716,086

[22] Filed: Mar. 26, 1985

[51] Int. Cl.[4] ..... A47C 17/14

[52] U.S. Cl. ..... 5/13; 5/18 B

[58] Field of Search ..... 5/13, 18 R, 18 B, 12, 5/17, 47, 63, 66, 24

[56] References Cited

U.S. PATENT DOCUMENTS

| | | | |
|---|---|---|---|
| 327,605 | 10/1885 | Shaw | 5/18 B |
| 565,536 | 8/1896 | Fay et al. | 5/18 B |
| 1,885,812 | 11/1932 | Fichtenbaum | 5/13 |
| 1,978,902 | 10/1934 | Jackson | 5/24 |
| 2,853,717 | 9/1958 | Firsel | 5/17 |
| 2,865,175 | 12/1958 | Gonder | 5/13 X |
| 2,913,736 | 11/1959 | Bronstien, Jr. et al. | 5/13 |
| 2,982,974 | 5/1961 | Bronstein | 5/13 |
| 3,019,454 | 2/1962 | Luca | 5/17 |
| 3,028,607 | 4/1962 | Anderson | 5/17 |
| 3,064,276 | 11/1962 | Newson, III | 5/17 |
| 3,299,445 | 1/1967 | Steffan | 5/13 |
| 3,458,877 | 8/1969 | Edwards | 5/13 X |
| 4,067,073 | 1/1978 | Komarov | 5/13 |
| 4,074,371 | 2/1978 | Lindbloom | 5/18 R |

FOREIGN PATENT DOCUMENTS

| | | | |
|---|---|---|---|
| 50991 | 12/1935 | Denmark | 5/13 |
| 494630 | 3/1930 | Fed. Rep. of Germany | 5/17 |

*Primary Examiner*—John E. Murtagh
*Assistant Examiner*—Richard Chilcot
*Attorney, Agent, or Firm*—Sheridan, Ross & McIntosh

[57] ABSTRACT

An automated sofa bed includes the usual elements and structure of a conventional sofa, an extensible articulated bed frame, and power means to extend and retract the frame. The basic sofa includes a rigid, stationary frame adapted to receive conventional seating pillows and formed with a cavity to receive the folded articulated bed frame. The bed frame comprises a plurality of generally rectangular sections pivotally connected to each other on traverse axes and foldable into a relatively compact package storable within the cavity in the rigid stationary frame, and extendable into a relatively horizontal arrangement suitable for use as a bed. At least one section of the bed frame is mounted on pivotal links to control its path of movement, and power means is applied through floating power links to the bed frame to move it between its extended and stored positions. The preferred form of power means includes cable means connected to the floating power links and an electric motor to drive the cable.

23 Claims, 17 Drawing Figures

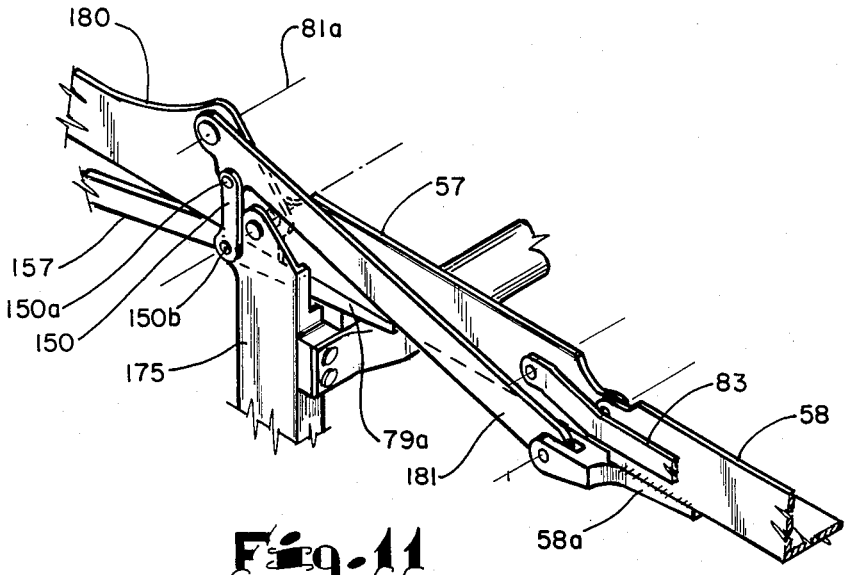
Fig-11
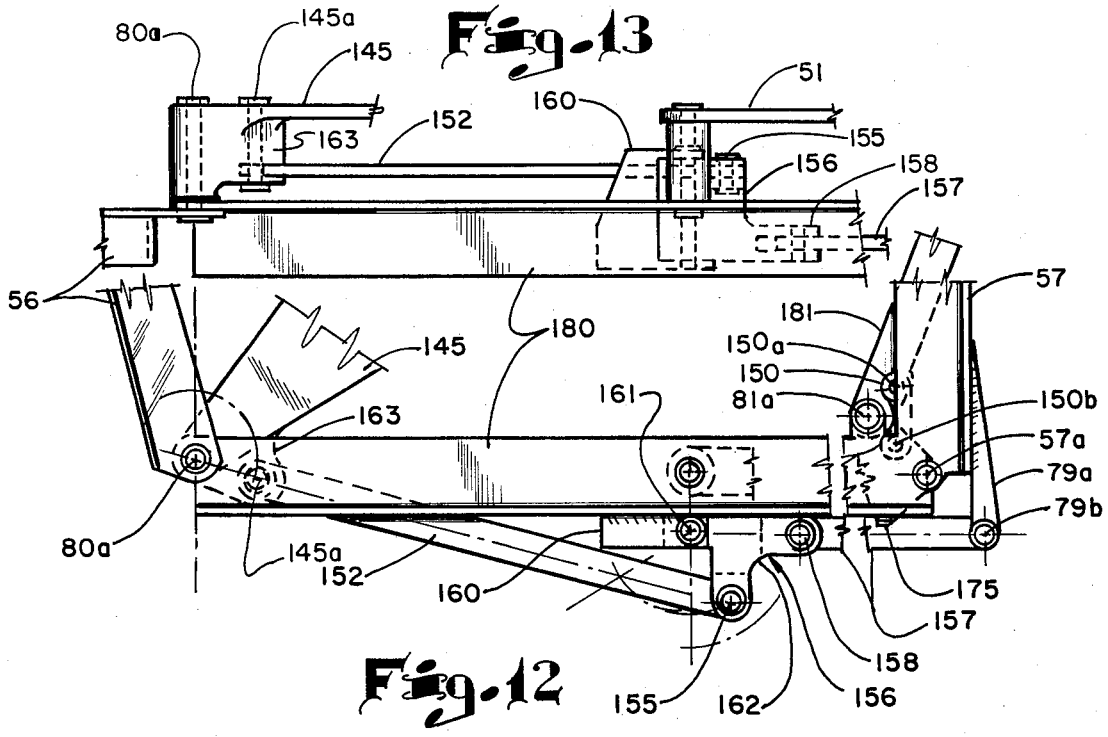
Fig-13
Fig-12

AUTOMATED SOFA BED

TECHNICAL FIELD

This invention relates to the general field of convertible furniture and is more particularly related to the type of sofa or chair, generally referred to as sofa bed, which is constructed and arranged to provide seating for general daytime use and also to be opened out into a suitable bed for sleeping. The purpose of the invention is to provide a construction which extends and retracts smoothly and easily with all the components of the foldable bed frame moving continuously and uninterruptedly between the two extreme positions. The construction includes power means, preferably in the form of a reversible electric motor connected through a cable loop to selected components of the bed frame, controlled by an operator to produce the desired movements. It is so designed that it can be operated manually in the event of power failure without requiring the disconnection or adjustment of any of the elements.

BACKGROUND ART

Convertible furniture has been in use for many years and has served well to provide additional sleeping accommodations for both regular and occasional use. The furniture may be an elongate sofa or a suitable chair and both will be included in the term "sofa" or "sofa bed" as used hereinafter. Most of such furniture now on the market is in the form of an elongate sofa bed having loose seat cushions which may be removed and set aside to expose an articulated bed frame assembly folded in compact arrangement and stored within a cavity in the rigid stationary frame of the sofa. One section of the assembly is pivotally connected to the stationary frame on a transverse axis, and the section which is uppermost in storage position may be grasped and manually raised and pulled outwardly. All of the sections are pivotally connected to each other to be unfolded successively as the extension movement proceeds, to form a substantially horizontal bed frame with supporting legs extending down beneath the outer portions.

The manual operations involved in extending and retracting the frame have proven to be both difficult and laborious. The sections are large and the operator must bend far forward to grip them. In addition they are rather heavy, so that the elderly and infirm are hard pressed to manipulate them. Many efforts have been made to overcome the difficulties by applying a power drive to the system of links and levers, and they have succeeded in eliminating the burden on the operator. However, the known power drive systems suffer from one or more drawbacks. One of the most serious is that they unfold and extend the sections in separate independent steps. using pin and slot sliding connections, cams, and limit stops to complete one swinging motion and commence the next. The result is a loose-jointed assembly which tends to misalign, bind, and stick while making a substantial amount of noise. None of them has a really positive system for maintaining accurate alignment of the transversely spaced sets of linkages to prevent binding. And none of them is so constructed that it can be operated manually in the event of power failure without disconnection or adjustment of some of the operating parts.

The patent to Willis, U.S. Pat. No. 2,934,770, dated May 3, 1960, discloses a worm/nut drive at each side of an articulated bed frame assembly operated by an electric motor to extend or retract the frame assembly. Push bars actuated by the worm/nut drives extend and retract the frame sections. The linkage includes pin and slot connections, cams, and limit stops to produce independent, discontinuous movements of the frame sections. The push bars have to be disconnected to permit manual operation of the assembly.

The patent to Thomas, U.S. Pat. No. 2,972,753, dated Feb. 28, 1961, discloses a drive linkage for extending and retracting the frame assembly actuated by a rack and pinion drive operated by an electric motor. The motor is at one side of the bed, and the long torque shaft extending to the drive at the other side is subject to torsional twisting which can cause misalignment between the two drives. There is no cable drive and there is no provision for mattress storage.

The patent to Heisler, U.S. Pat. No. 3,080,574, dated Mar. 12, 1963, discloses a manually extended and retracted frame assembly having one frame section slidable over the other and a cable loop to maintain alignment. There is no power drive and no practical way to apply one.

The patent to Katz, U.S. Pat. No. 3,281,871, dated Nov. 1, 1966 discloses diamond shaped throw-out links pivotally anchored to the stationary frame. The linkage is manually actuated and folds and unfolds in step by step sequence.

The patent to Usievich, U.S. Pat. No. 1,260,600, dated Mar. 26, 1918, discloses a three section frame assembly, pivotally carried by a pair of triangular links pivotally connected to the stationary frame. There is no power drive, and the assembly is folded and unfolded manually in a step by step operation.

DISCLOSURE OF INVENTION

In accordance with this invention, a convertible sofa bed is provided which includes a substantially rigid stationary sofa having a storage cavity therein and an articulated bed frame assembly which is foldable and storable within the cavity and unfoldable and extendable into a generally horizontal bed frame. The stationary sofa frame has the same general lines and structure as a conventional sofa and is formed with a storage cavity beneath and behind the seating portion. An articulated bed frame assembly is foldable into a compact package which is retractable within the cavity and extendable therefrom into an elongate generally horizontal structure suitable to serve as a bed.

The assembly preferably includes a primary upper torso support section, a secondary lower torso support section, and a terminal leg support section, each section being generally rectangular in planform and defined by two transversely spaced longitudinally extending frame members and pivotally connected to adjacent sections on transversely extending pivot axes. Actuating mechanism for the frame assembly comprises transversely spaced control and support linkages pivotally mounted at first ends to the stationary frame and pivotally connected at second ends to an end and midportion of the floating power link to rotate and translate it in a vertical plane.

The second end of each floating power link is pivotally connected to the inner end of one of the frame members of the primary section, with the rotation and translation of the floating power link serving to translate the frame assembly out of and into the stationary frame about the control and support linkage.

Power means are connected to the floating power links to drive them in their extension and retraction movements. The means includes a closed loop cable system trained over appropriately located pulleys and extending across the back of the stationary frame, down to the lower rear corners, and then forwardly and upwardly to locations near the upper forward corners of the frame. Thus, there are two runs of the cable at each side in generally parallel arrangement passing over the upper forward pulleys. A selected run at each side is pivotally anchored to the adjacent floating power link at a point spaced inwardly from the pivotal connection of the link's second end to the primary frame section, toward the first end of the link. The presently preferred spacing is of the order of one third of the length of the link. The appropriate runs are anchored so that as they move upwardly toward the pulleys they move the floating power links with them and cause the links to rotate counter-clockwise and translate upwardly and forwardly about their pivotal connections with their guide links. The movement translates the primary frame section outwardly to a horizontal position about its guide links.

The cable system is driven by a reversible electric motor provided with a drum around which a mid portion of the cable loop is wrapped and anchored. When the motor rotates in a first direction the primary section is extended. When it rotates in the opposite direction the primary section is retracted.

The secondary section is swingable through ninety degrees about a transverse axis between a position at ninety degrees to the primary section and a position in alignment with the primary section. The terminal section is swingable through ninety degrees to the secondary section and overlying but spaced from the primary section, to provide space for a folded mattress, and a position in alignment with the secondary section and the primary section to form a body-supporting horizontal framework.

A first crank arm is pivotally mounted on each side frame member of the primary section at an intermediate point in its length.

Second crank arms are fixedly connected to the inner ends of the side frame members of the secondary section, and push rods are pivotally connected to and extend between the first crank arms and the second crank arms to cause the secondary section to swing through its ninety degree angle in response to longitudinal movement of the push rods.

Third crank arms are fixedly connected to the inner ends of the side frame members of the terminal section, and push rods are pivotally connected to and extend between the second crank arms and the third crank arms to cause the terminal section to swing through its ninety degree angle in response to longitudinal movements of its associated rods.

Additional push rods are pivotally connected to and extend between the first crank arms and selected elements of the linkage members supporting the assembly for rotation and translation. The presently preferred pivot mountings for the inner ends of these additional push rods are located on the floating power links spaced inwardly from the pivotal connections between the floating power links and the primary section. These selected elements are adapted to move the additional push rods longitudinally with respect to the primary section during extension and retraction and produce continuous and progressive folding and unfolding action of the frame sections.

Foldable legs to support the extended frame assembly in the bed attitude are pivotally mounted at the juncture of the primary and secondary sections and at an intermediate point on the terminal section, and additional push rods are connected to crank arms on the legs to fold and unfold them in response to longitudinal movement of the previously mentioned push rods.

Various other advantages and featurs of novelty will become apparent as the description proceeds in conjunction with the accompanying drawings.

BRIEF DESCRIPTION OF THE DRAWINGS

FIG. 11 is a fragmentary perspective view of a modification of the articulated frame in the extended state showing a preferred arrangement for extending intermediate legs of the articulated frame.

FIG. 12 is a fragmentary side elevational view of a modification of the articulated frame in the retracted position to show a modified version of the floating power link and a different control linkage for actuating the subsequent frame sections.

FIG. 13 is a fragmentary top plan view of the structure shown in FIG. 12.

DESCRIPTION OF PREFERRED EMBODIMANTS

Figure 1:
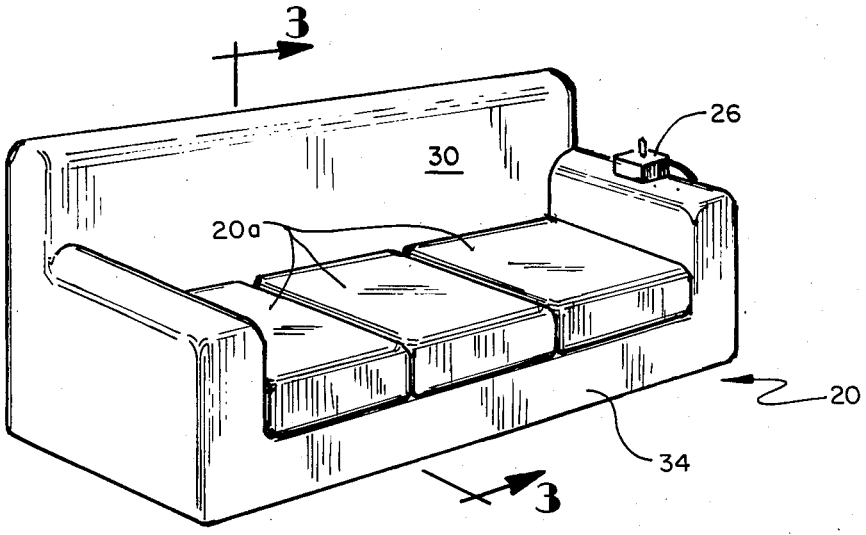
FIG. 1 is a perspective view of a convertible sofa bed embodying the present invention shown in the retracted state.
Figure 2:
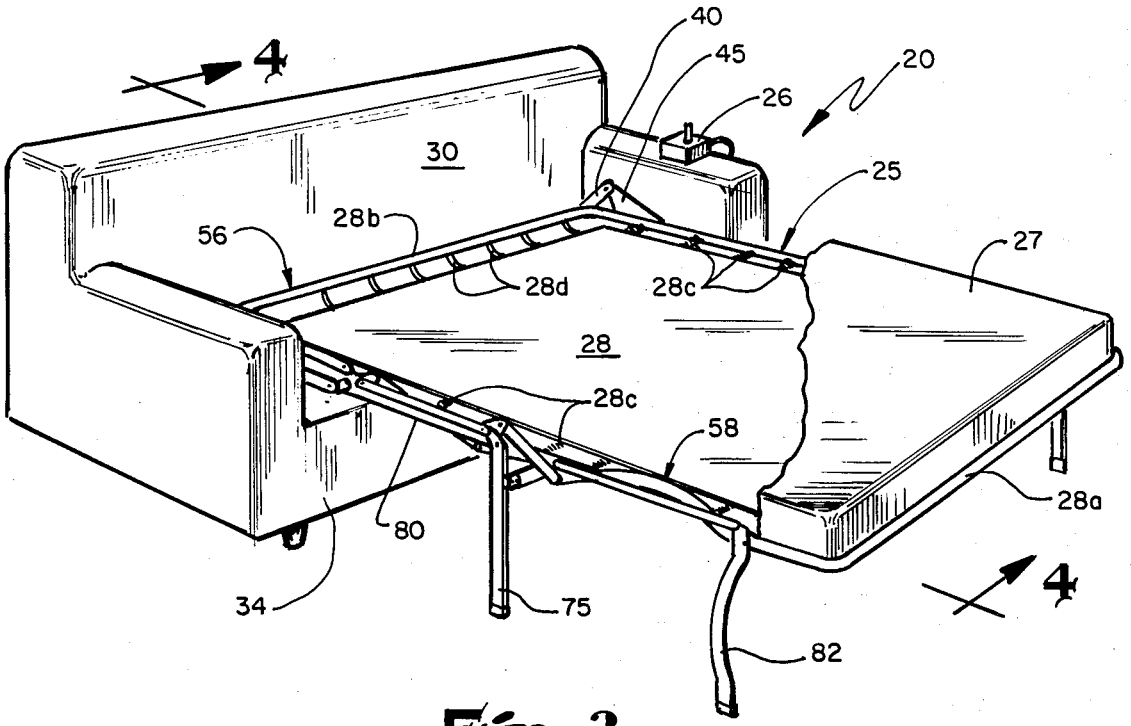
FIG. 2 is a fragmentary diagrammatic perspective view of the sofa bed shown in FIG. 1 in the extended state with a mattress cut away to illustrate an articulated frame assembly in the extended state.

Illustrated in FIGS. 1 and 2 is a convertible article of furniture 20 embodying the present invention. In this exemplary embodiment, the convertible article of furniture 20 is in the form of a sofa bed and will be referred to as such hereinafter. When used as a sofa and in the retracted state, cushions 20*a* are placed above an articulated frame assembly 25. When used as a bed, the cushions 20*a* are removed (FIG. 2) and a controller 26 is activated by an operator to extend fully the frame assembly 25. Activating the controller 26 when the frame assembly 25 is fully extended returns the frame assembly 25 to the completely retracted state. A suitable mattress 27 is fastened to the frame assembly 25. The mattress 27 is folded with the frame assembly 25 in the retracted state and is fully extended on the frame assembly 25 in the extended state. The frame assembly 25 includes a conventional fabric or linked metal mattress support 28 held in place with helical springs 28*c* and spring wire 28*d*. The support 28 is attached to frame members 28*a* and 28*b* and also to the pivotally interconnected longitudinal side members or sections of the articulated frame assembly 25 to be described in detail hereinafter.

The convertible article of furniture or sofa bed 20 of the present invention comprises a transversely and laterally extending stationary frame assembly 30 and the frame assembly 25. The stationary frame assembly 30 includes a pair of rear feet or rear pedestals 31 and a pair of forward feet or forward pedestals 32. In addition thereto, the stationary frame assembly 30 includes a transversely extending back frame member 33 that is fixed to the rear feet 31 and a transversely extending upright front frame member 34 that is fixed to the forward feet 32. Additionally, the stationary frame 30 includes a transversely extending upright intermediate frame member 35 that is spaced forwardly of the back member 33 and is rigidly connected thereto by transversely longitudinally extending interconnecting frame member 36. The intermediate frame member 35 extends from the interconnecting frame member 36 a distance above the bottom of the stationary frame members 33 and 34. Longitudinal side structural members 38 of frame assembly 30 form a support for the sofa side arm rests and also complete the stationary structure to form a rigid composite structure for the support of the articulated frame assembly 25. Through conventional upholstery and frame construction of a sofa, the stationary frame 30 is rigid and provides the stiffness required for the side-to-side construction of the sofa bed 20.

The articulated frame assembly 25 is pivotally connected to the stationary frame 30. To this end, transversely spaced, elbow configured links 40 are pivotally connected at one end thereof about a fixedly positioned axis 40*a* to transversely spaced brackets 40*b* and at the other end thereof the links 40 are pivotally connected to transversely spaced floating power links 45 at one angle or junction 45*c* of the legs thereof. In the exemplary embodiment, the floating power links 45 have triangular configurations. However, they are not so limited. The basic feature of such link is that it is preferably elongate, has a pivot mounting near each end and has a third intermediate pivot mounting laterally spaced from a centerline extending between the first two, this producing a triangular planform of pivot mounting points. The employment of floating power links provides relatively long travel with relatively short linkage.

Transversely spaced links 46 are pivotally connected at one end thereof about a fixedly positioned axis 46*a* to transversely spaced members 38 of the stationary frame 30 and at the other end thereof, the links 46 are pivotally connected to the power links 45 at 46*b*. Transversely spaced links 50 are pivotally connected at one end thereof about fixedly positioned axes 50*a* to transversely spaced members 38 of the stationary frame 30 and at the other end thereof, the links 50 are pivotally connected to respective transversely spaced links 51 at 50*b*. Each of the remaining leg junctions of the floating power links 45 is pivotally connected at 80*a* in transverse spaced relation to the primary upper torso support section 80 of the frame assembly 25.

Figure 3:
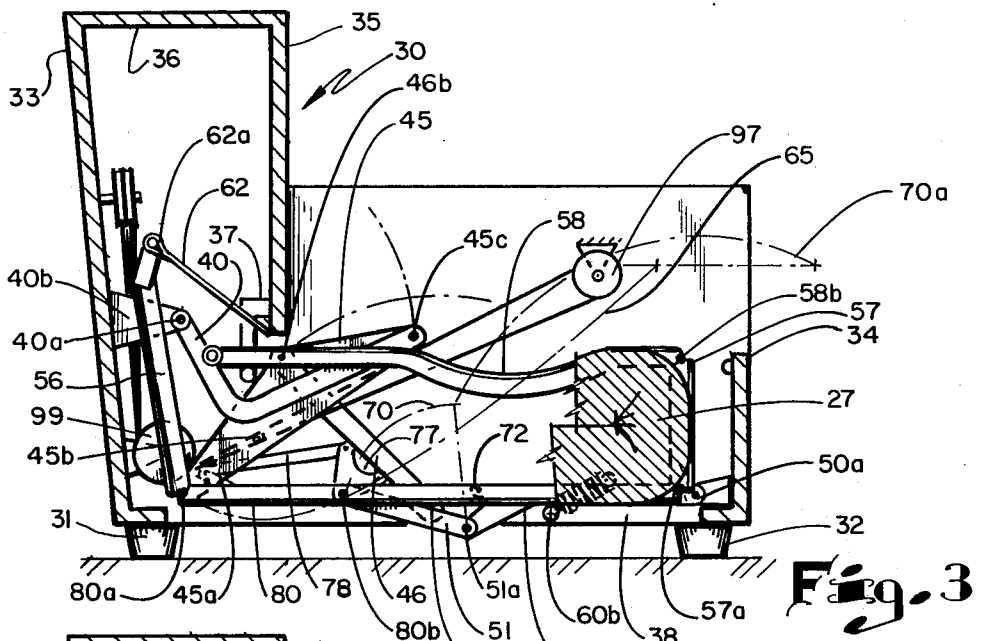
FIG. 3 is a fragmentary diagrammatic vertical sectional view of the sofa bed shown in FIGS. 1 and 2 taken along line 3—3 of FIG. 1 to illustrate a stationary frame and the articulated frame assembly in the retracted state.
Figure 4:
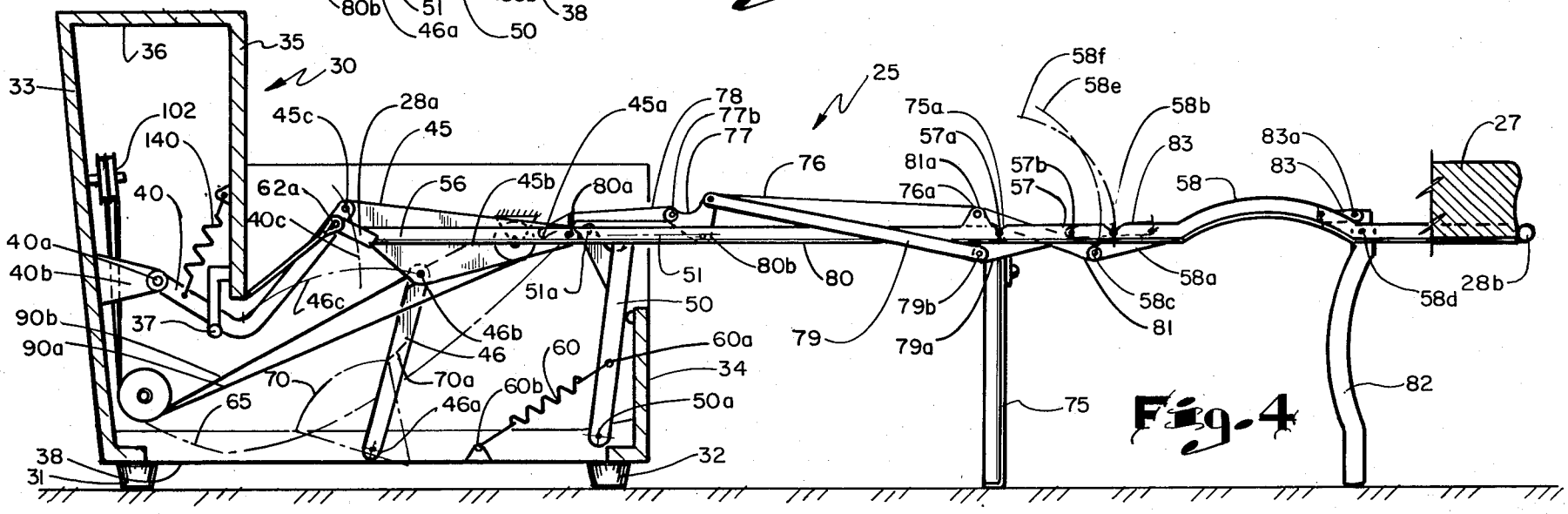
FIG. 4 is a fragmentary diagrammatic vertical sectional view of the sofa bed shown in FIGS. 1 and 2 taken along line 4—4 of FIG. 2 to illustrate the stationary frame and the articulated frame assembly in the extended state.

The frame assembly 25 comprises pivotally connected sections. One of these sections is the primary upper torso support section 80. Another section of the frame assembly 25 is a head support section 56 (FIGS. 3 and 4). The adjacent ends of section 56 and section 80 are pivotally connected at 80*a* to one another and to one of the junctions of the power links 45. The primary section 80 at the opposite end thereof is pivotally connected to a secondary lower torso support section 57 at 57*a*. A terminal leg support section 58 of the frame assembly 25 is pivotally connected to secondary section 57 of the frame assembly 25 at 58*b*.

Transversely spaced springs 60 may be connected at one end to the transversely spaced links 50 at point 60*a* and at the other end thereof to transversely spaced members 38 of the stationary frame 30 at point 60*b*. Point 60*b* also provides a counterrotational stop for link 50. When the frame assembly 25 is fully extended, the springs 60 apply a retraction directed force to the links 50 to reduce the power required to initiate moving the frame assembly 25 towards the retracted position. Transversely spaced head support section 56 guides 62 (FIG. 3) are anchored to the transversely extending stationary member 35 of the stationary frame assembly 30, and at the other end, guides 62 are pivotally connected at 62*a* to the head support section 56. The head support section guides 62 could be springs, bungees, or non-elastic flexible members that control the path of the extreme head end of section 56 during extend and retract motions. The head support section 56 is pivotally connected at pivot 80*a* to transversely spaced frame section 80.

Each portion of the assembly comprises two sets of substantially identical frame elements transversely spaced at each side of the bed, and the actuating components likewise comprise two sets of substantially identical actuating elements transversely spaced at each side of the bed. For simplicity, the more detailed description will be generally confined to the elements and components at one side of the apparatus. The drive equipment is connected to and operates both sets and will be so described.

Figure 5:
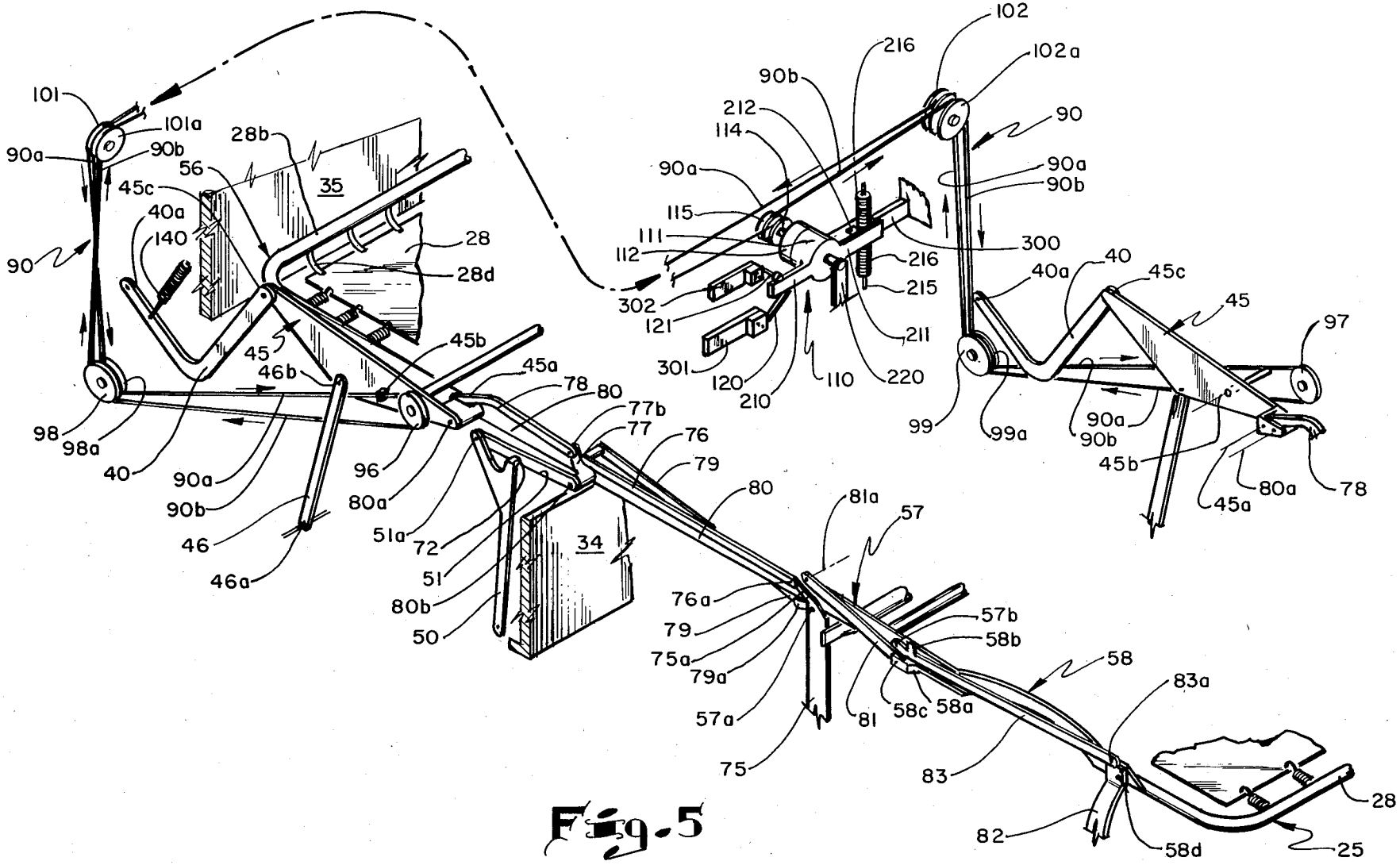
FIG. 5 is a fragmentary diagrammatic perspective view of the articulated frame assembly shown in FIGS. 2–4 in the extended state and illustrated with a cable drive arrangement for applying an extension directed force and a retraction directed force to the articulated frame assembly.

The entire extension and retraction of the frame assembly 25 occurs in response to the guided and controlled movements of floating power links 45. As can be seen in FIGS. 3, 4, and 5, each link 45 is carried by links 40 and 46. Pivot mount 45*c*, connecting links 40 and 45, is confined in its travel to arc path 40*c*, and pivot mount 46*b*, connecting links 46 and 45, is confined in its travel to arc path 46*c*. When an extension force is applied to link 45, the links 40 and 46 cause it to rotate in a counter clockwise direction as viewed in FIGS. 3 and 4 and to translate outwardly from the storage cavity in the stationary frame. When a retraction force is applied to link 45, the guide links cause it to move in the reverse sense or direction.

The extension and retraction forces are applied by an electrically powered closed loop cable system generally designated 90. Several lengths of cable may be used and secured together to form one continuous loop arranged as shown in FIG. 5. Each power link 45 is provided with a pivotally mounted cable attach fitting 45*b* located inward of pivot 80*a* by a distance of the order of one third of the length of the link. The two adjacent ends of the cable lengths designated 90*a* and 90*b* are secured to the attach fitting by any suitable means at each side, producing an essentially unitary loop. Shorter sections may be used and united by swaging or the like.

With frame assembly 25 in retracted condition, actuator 110 is operated to move the two cable portions in the direction of the arrows as seen in FIG. 5. Thus, on the right hand side of the apparatus as viewed from the front in FIG. 5, tension will be applied to cable 90*a* extending between fitting 45*b* and pulley 97, and on the left hand side tension will be applied to cable 90*b* extending between fitting 45*b* and pulley 96. This will swing links 45 from the retracted position of FIG. 3 to the extended position of FIGS. 4 and 5. When the actuator is operated in the reverse direction the tensions will be applied to cable 90*b* on the right and cable 90*a* on the left, retracting the assembly into its folded position in the storage cavity.

The two upward and forward single pulleys 96 and 97 are carried by the side walls of frame 30. Dual individual pulleys 98 and 98*a* are arranged in the lower left rear corner of the cavity, and similar pulleys 99 and 99*a* are arranged in the other rear corner. Dual pulleys 101 and 101*a* are located above pulleys 98 and 98*a*, and dual pulleys 101*a* and 102*a* are located above pulleys 99 and 99*a*.

Figure 6:
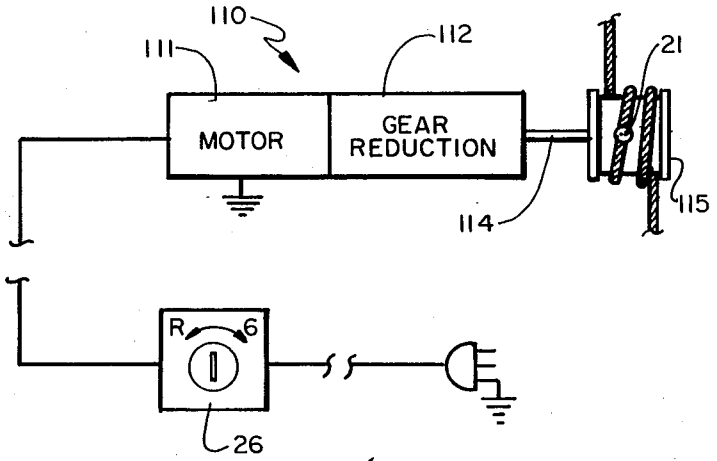
FIG. 6 is a block diagram of the motor drive arrangement employed in the sofa bed shown in FIGS. 1–4 for actuating the cable drive arrangement shown in FIG. 5.

The actuator for the cable system includes a motor 111, pivotally mounted on support 220, provided with a reduction gear box 112 from which extends drive shaft 114 carrying at its end a cable drum 115. The upper horizontal pass of cable 90*b* is wrapped around the drum a sufficient number of times to allow for the necessary extension and retraction of the cable in either direction to move the frame assembly between its two extreme positions. As best seen in FIG. 6, an anchor 21 is secured to a selected point on the cable and locked to a midpoint of the drum to prevent any slippage of the cable as it is payed in and out in either direction. Other features of the actuator system will be described hereinafter.

Cable 90*b* extends from the drum to pulley 102*a*, then down around pulley 99*a*, then up to the fitting 45*b*. In the opposite direction cable 90*b* passes from the drum to and over pulley 101*a*, down and over pulley 98, and up and over pulley 96 to fitting 45*b*. Cable 90*a* bypasses the drum and runs to the right over pulley 102, down and over pulley 99, and up and over pulley 97 to fitting 45*b*. In the opposite direction, cable 90*a* runs to the left to and over pulley 101, down and over pulley 98*a* and up to fitting 45*b*. When the actuator moves the cables in the direction of the arrows, with the assembly in retracted condition, cable 90*b* on the left side will exert tension between pulley 96 and fitting 45*b*. At the same time cable 90*a* on the right side will exert tension between pulley 97 and fitting 45*b*. since there is no slack in the cable system, both links 45 will be drawn out evenly and there will be no jamming. All of the cables will move evenly in the opposite direction when the actuator rotates in reverse, and cables 90*b* on the right and 90*a* on the left will exert tension on links 45 to produce folding and retraction of the frame assembly.

The inner end of frame section 80 is pivotally connected to floating power link 45 at pivot mounting 80*a*, which also serves to pivotally mount the head support section 56 to the upper torso support section 80. The outer end of push rod 78 is pivotally connected to the free end of crank arm 77 at 77*b*, and its inner end is pivotally connected to the floating power link at 45*a*.

When an extension directed force is applied to floating power link 45, it is urged forwardly and upwardly. At the same time the guide or control links 40 and 46 cause the link 45 to rotate in a counter-clockwise direction as viewed in FIGS. 3 and 4. Link 51, pivotally connected at 51*a* to link 50, is pivotally connected to frame section 80 at pivot mounting 80*b* and link 50 is pivotally connected at pivot mounting 50*a* to the stationary frame. Thus, section 80 is supported and its movement is controlled by its pivotal connections to links 45 and 51, and the other three sections of the frame assembly are pivotally connected to and carried by section 80.

Figure 16:
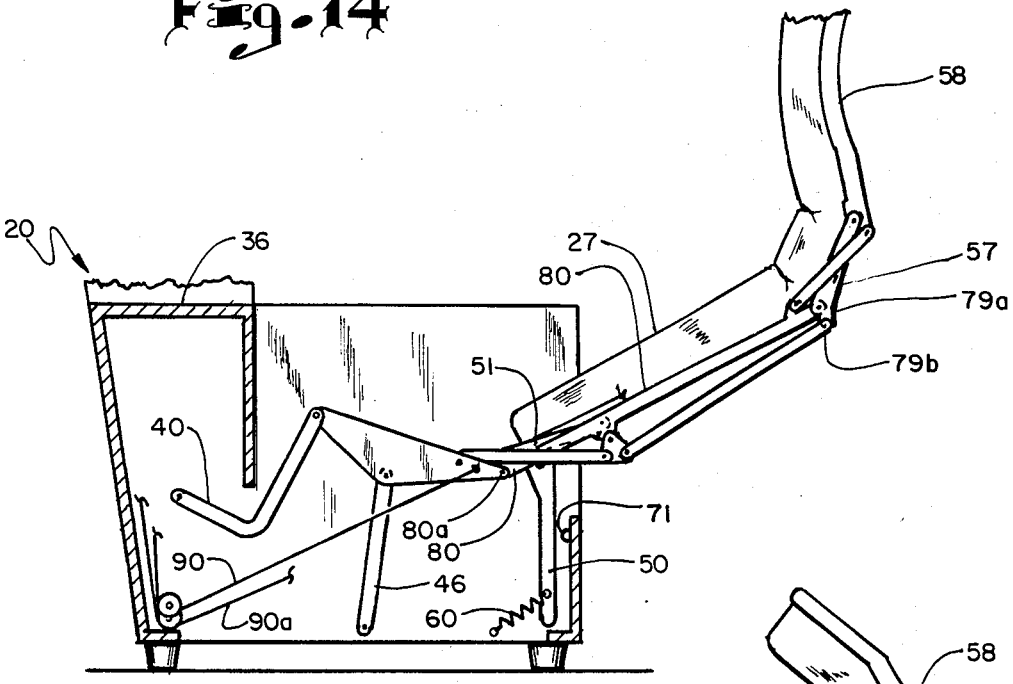

As extension is initiated and eventually completed, the pivot mounting 80*a* follows the path 65 as shown in FIGS. 3 and 4 and carries with it the inner end of section 80 along the same path. Link 51 initially swings clockwise about pivot 51*a*, which causes its pivotal connection 80*b* with section 80 to follow path 70 and bring section 80 to about the position shown in FIG. 14, extending upwardly and outwardly from the cavity in the stationary frame. Link 51 now engages stop or abutment 72 on the end of link 50. The two links now move in unison about pivot 50*a*, and the pivot mounting 80*b* then follows path 70*a* to complete extension. It will be apparent that in the first stages of extension the inner end of section 80 moves slightly down and forward while its outer end swings sharply up to clear the front cross member of the stationary frame. This movement also lowers the inner end of the folded leg support section 58 as it moves outwardly so that it clears the lower edge of cross member 35. Subsequent stages of the extension movement are illustrated diagrammatically in FIGS. 15 and 16. The control linkages and their operation will be set forth more in detail hereinafter.

As seen in FIG. 3, with the frame assembly in the fully retracted position of rest, a four bar linkage in the form of an approximate parallelogram is made up of link 78, crank arm 77, the inner portion of section 80 between pivot points 80*b* and 80*a*, and the portion of link 45 between pivot points 80*a* and the portion of link 45 between pivot points 80*a* and 45*a*. The variable angle between link 45 and section 80 controls the fore and aft position of link 78 with respect to section 80 and thus controls the angle of crank arm 77 with respect to section 80. In turn, the angular movement of crank arm 77 controls the folding and unfolding of sections 57 and 58 together with legs 75 and 82. All of the components, including those to be described, are pivotally connected together with close-fitting pivots and there are no pin and slot or other sliding connections in the assembly and there is effectively no free play. Thus, all of the components are under the continuous and complete control of link 45.

Figure 14:
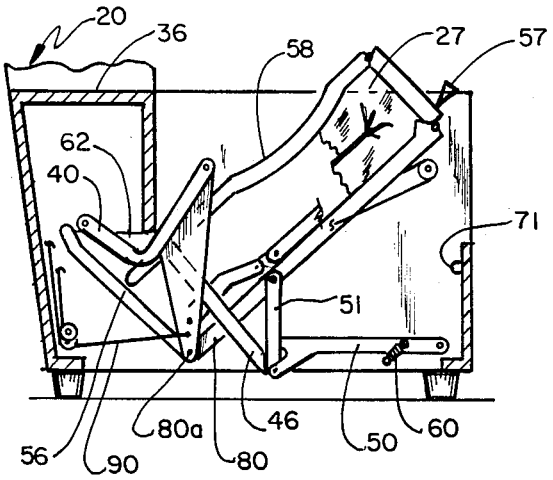
FIGS. 14–17 are fragmentary diagrammatic side elevational views of the sofa bed shown in FIGS. 1–5 illustrating the movement of the articulated frame in progression from a retracted state to an extended state.
Figure 17:
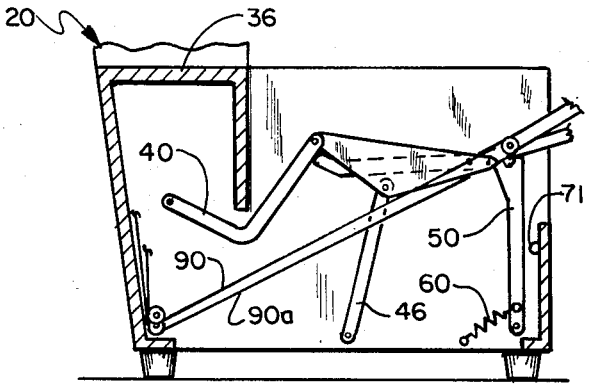
Figure 15:
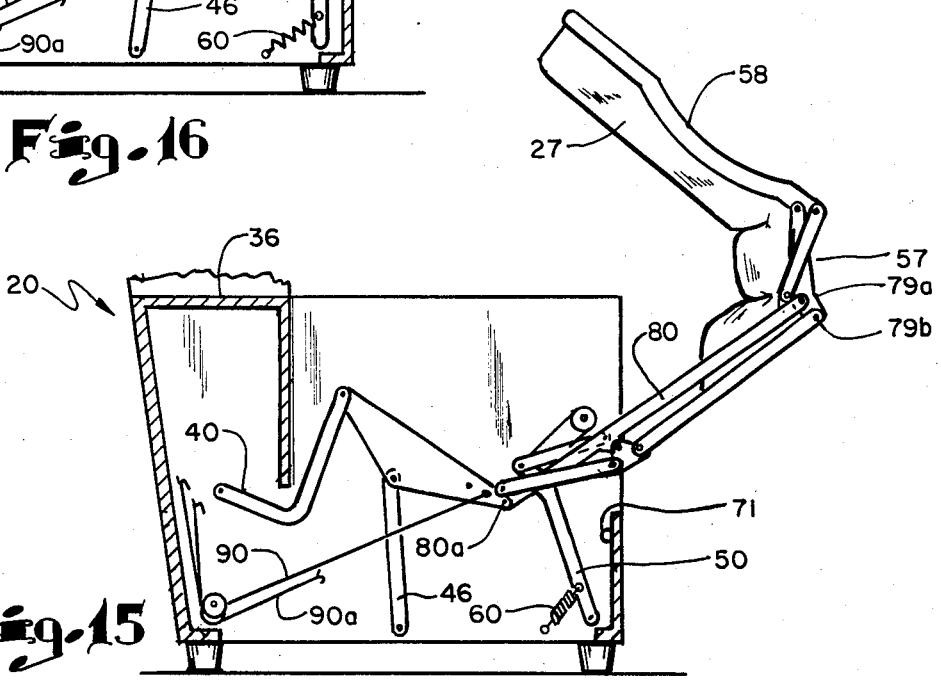

It will be seen that, as the assembly moved from the position of FIG. 3 to approximately the position of FIG. 14, the angle between link 45 and section 80 opens up only slightly and therefore the unfolding action is almost insignificant, with the result that interference with the stationary frame is avoided. As the assembly moves through the positions indicated diagrammatically in FIGS. 15 and 16 to the final position of FIG. 4, the unfolding action is accelerated as will be explained.

Continued extension movement causes the angle between link 45 and section 80 to increase from about 45 degrees to about 180 degrees. The counter-clockwise rotation of link 45 draws link 78 aft to cause crank arm 77 to rotate counter-clockwise, pulling links 76 and 79 aft. Bracket 79*a* is fixedly connected at 79*b* to link 79. Section 57 is pivotally connected to section 80 at pivot point 57*a*. When link 79 moves aft it pulls on bracket 79*a* and swings it and section 57 from a position at 90 degrees to section 80 down into alignment with it.

Leg 75 is pivotally connected to sections 80 and 57 at pivot point 57*a* and has an angled extension 75*a* which is pivotally connected at 76*a* to link 76. When link 76 is moved aft it swings leg 75 from a position folded against section 80 down to the position shown in FIG. 6. Link 81 is pivotally connected to upper torso support section 80 at pivot 81*a*, which is coaxial with pivot 76*a* but spaced laterally from it.

Section 58 is pivotally connected at pivot point 58*b* to section 57 and is provided with a fixedly secured bracket 58*a*. Link 81 is pivotally connected to section 80 at pivot 81*a*, which is independent of pivot 76*a*, and at 58*c*. When link 76 moves aft it unfolds leg 75 as previously described. As the bed is moved from the retracted position towards the extended position, link 79 moves aft, pivot 79*b* of fitting 79*a* is moved aft and swings section 57 clockwise into alignment with section 80. As pivot 58*b* moves from retracted position along the arc path 58*f* towards bed extension position, link 81 pivoting at 81*a* forces pivot 58*c* to follow arc path 58*e* thus forcing section 58 to rotate with respect to section 57. In the bed extended position, sections 80, 57, and 58 are aligned.

Leg 82 is pivotally carried by section 58 at pivot mounting 58*d* to swing from a position folded up against section 58 down into the support position shown in FIG. 4. To control this movement a link 83 is pivotally mounted on section 57 at point 57*b*, inwardly offset from pivot 58*b*. At its free end it is pivotally connected at point 83*a* to a short extension of leg 82. When section 58 is folded at ninety degrees to section 57, link 83 stands almost parallel to leg 82 but with its anchorage 57*b* inwardly offset from pivot point 58*b* and with pivot connection 83*a* inwardly offset from pivot 58*d*. As section 58 swings toward alignment with section 57 the link 83 is effectively foreshortened and pulls leg 82 from folded to extended position.

From the above it will be seen that as floating power link 45 swings counterclockwise with respect to section 80 between the positions of FIG. 3 and FIG. 4 it pulls on link 78 which pulls on links 76 and 79 to unfold section 57 and leg 75. The unfolding of sections 80 and 57 with respect to each other forces the unfolding of section 58 with respect to section 57. The unfolding of section 58 with respect to section 57 causes link 83 to unfold 82. Since all of the links are pivotally connected together without any lost motion connections, the entire extension and unfolding operation proceeds continuously and progressively, and the delay in initial unfolding precludes interference of the frame assembly with elements of the stationary frame. All of the control links and components operate in the reverse direction during retraction of links 45 in the clockwise direction to return to the position shown in FIG. 3, with the folding of the assembly being substantially complete before the assembly re-enters the cavity in the stationary frame. The head support section 56 is pivotally connected to the inner end of section 80 at pivot mount 80*a* and swings freely during extension and retraction except for the restraint of spring or bungee or flexible inelastic member 62 which guides its free end during translation. The pivotal mounting connections 80*a*, 57*a*, and 58*b* between the four sections of the total frame assembly are all of the 90 degree limit stop type, as best seen at 58*b* in FIG. 3, to insure that the proper angular relation between the sections will be maintained in the retracted and extended positions.

Spring 60 is anchored to the stationary frame 30 and connected to link 50 to provide a retraction force at the beginning of the retraction operation and reduce the load on the power source. Springs shown and not shown, are strategically placed and connected to provide a balancing action between the stationary frame 30, frame assembly 25, and the mattress 27, and reduce the load on the power source to a great extent. To improve the rigidity of the frame assembly 25 in the retracted state, a support 37 for the frame member 28*b* may be incorporated, As 28*b* moves under member 35, a support 37 attached to member 35 provides a resting surface at each side of frame member 28*b*.

As previously mentioned, the entire cable loop system is driven by actuator 110, which includes reversible motor 111, gear reduction 112, shaft 114 and cable drum 115, pivotally carried by support 220, all as best shown in FIG. 5. The motor casing is provided with two oppositely extending arms 210 and 211. Arm 211 is formed with a slot 212 to form a yoke. Support bar 300 is anchored to the structure and carries vertically extending pin 215 on which are mounted two compression springs 216. When the free end of bar 300 is inserted into slot 212 the springs 216 press on the upper and lower faces of arm 211 to yieldingly restrain it against rotary movement.

Support bars 301 and 302 are anchored to the structure and carry limit switches 120 and 121 with terminals contacting arm 210. When the motor is operating under normal load extending and retracting the frame assembly, the force of springs 216 is sufficient to overcome the reaction torque of the motor casing and maintain arm 211 in neutral position. However, if the motor is stalled by jamming or by the frame assembly reaching one of its extreme positions with power still being applied, then the reaction torque will increase and overcome the resistance of one of the springs so that the motor casing will rotate slightly, and arm 210 will move one of the limit switches and open the circuit.

If power to the motor is off for any reason it is desirable to be able to extend and retract the assembly manually. In the preferred form the gear reduction drive utilizes spur or planetary gears which are reversible with suitable gear ratios.

Figure 7:
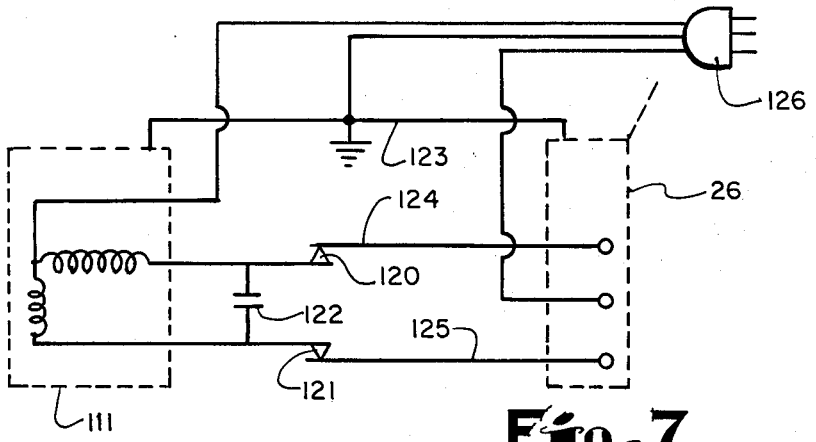
FIG. 7 is a schematic diagram of circuit connections between a controller and a motor shown in FIG. 6 employing limit switches.

Illustrated in FIG. 7 is a preferred embodiment of a circuit arrangement between the motor 111 and the controller 26. An electric motor is a source of concentrated power and is therefor potentially hazardous. The potential hazard can be greatly minimized by the proper motor selection, installation, thermal protection, and overload protection. All of the electrical components including the wiring and installation should be manufactured and installed to comply to existing applicable safety standards and in particular to those issued by ANSI (American National Standards Institute), NEMA (National Electrical Manufacturers Association), U.L. (Underwriters Laboratories, Inc.,) and C.S.A. (Canadian Standards Association.) Ref/Standards Publication No./ANSI C51-1/NEMA, "Safety Standard for Construction and Guide for Selection, Installation and use of Electric Motors and Generators". Many different types of motors and drive systems could b used. However, one used will be described. The full size electrically operated, working model of the sofa bed incorporated a permanent split capacitor gear motor, single phase, 115 volt, 60 cycle. In the exemplary embodiment, the controller 26 is a conventional single pole, double throw switch preferably key operated to provide added safety, ref. FIG. 6. Interposed between the controller 26 and the motor 111 and incorporated in the electrical connections therebetween are limit switches 120 and 121. A capacitor 122 is connected to the motor clockwise and counter-clockwise rotational direction control wires. The capacitor 122 has to do with the starting characteristics of the motor and if its use is necessary, it is specified by the motor manufacturer. An electrical three wire plug 126 is connected to a power source. Conductor 123 is connected to the plug ground and also to the controller and motor housings to prevent any exposed metal from being an electrical hazard. The limit switches 120 and 121 are mechanical force limit switches. During normal operations, the extend limit switch 120 would operate only at the fully extended positions if the operator did not turn the controller 26 to the "Off" position. When the articulated frame assembly 25 is fully extended and cannot extend further, the driving force in the cable increases to a safe predetermined value, a spring 216 deflects allowing the extend limit switch 120 to operate cutting the power supply to the motor. At any position during extension if the driving force increases to the mentioned safe predetermined value, limit switch 120 would be operated cutting power to the motor. During retraction, the limit switch 121 serves the same purpose as the limit switch 120 does during extension. Conductors 124 and 125 interconnect the controller 26 with the limit switches 120 and 121 and the motor 111. A thermal protection switch, not shown, gives added protection against motor excessive heating due to some unpredictible fault.

Figure 8:
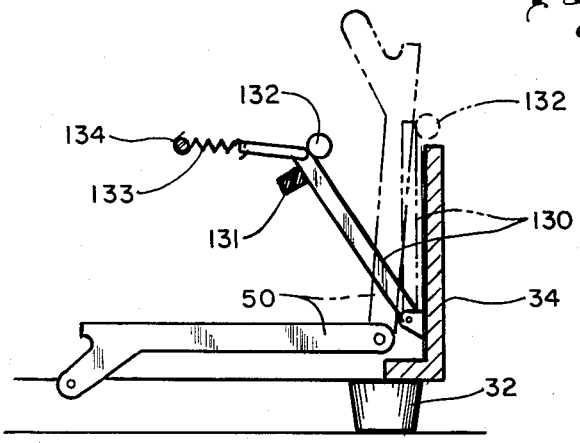
FIG. 8 is a fragmentary diagrammatic elevational view of a portion of a modified control linkage for the articulated frame to illustrate an arrangement for reducing the initial force required for retracting the articulated frame.

For reducing the magnitude of power required for initiating the retraction of frame assembly 25, the springs 60 were employed (FIG. 3). In FIG. 8 is illustrated an alternate arrangement for this purpose. In the alternate arrangement shown in FIG. 8 are transversely spaced links 130 which are pivotally connected to the stationary member 34 of the stationary frame 30. At the distal ends of the links 130 are stops 131 fixed to the stationary frame and rollers 132 carried by links 130. Transversely spaced springs 133 are connected at one end thereof to the distal ends of the links 130 and at the other end thereof are anchored to transversely spaced members 134 of the stationary frame 30.

When the transversely spaced links 50 pivot during the extension of the frame assembly 25, the links 50 engage the links 130, respectively, by way of rollers 132 and pivot the same forwardly against the urging of the springs 133 until the links 50 and 130 are generally upright. During the retraction of frame assembly 25, the springs 133 urge the links 130 rearwardly which, in turn, move the links 50 rearwardly during the initial rearward movement of the links 50 for the retraction of the articulated frame 25.

Figure 10:
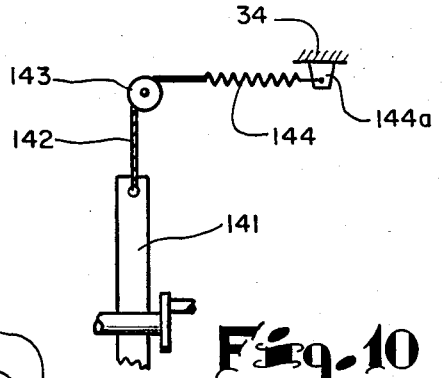
FIG. 10 is an elevational view taken along line 10—10 of FIG. 9 to illustrate an arrangement for applying the force unit.
Figure 9:
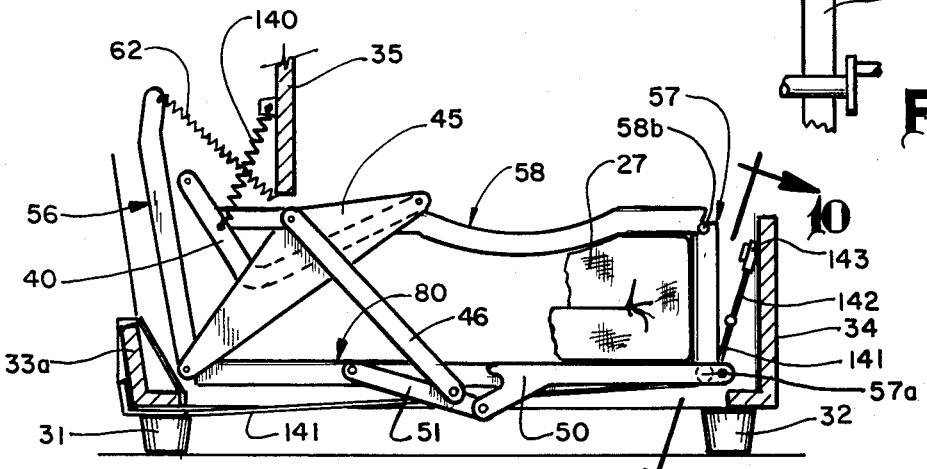
FIG. 9 is a fragmentary diagrammatic elevational view of a modification in which a force unit is applied to the articulated frame in a retracted state to illustrate an arrangement for reducing the force required for initiating the extension of the frame.

Illustrated in FIG. 9 is an arrangement for reducing the forces required to initiate the extension of the articulated frame 25 that may optionally be embodied in the present invention. Toward this end, transversely spaced springs 140 are attached to the elbow configured links 40 and are anchored to member 35 of frame 30. In addition thereto, a suitable strap or belt 141 (FIGS. 9 and 10) is disposed generally along the centerline of frame assembly 25 or generally midway between the sides of assembly 25. At one end thereof, the strap or belt is fixedly attached to the transversely extending portion 33*a* of frame member 33. It underlies but is not fixedly attached to the cross member (not shown) of section 80 which extends between the pivot mounts 57*a*. At the other end thereof, the strap or belt 141 is attached to one end of a cable 142, which is trained around an idler pulley 143. The pulley 143 is supported by the stationary frame 30 through a suitable bracket. At the other end thereof, the cable 142 is attached to a spring 144 (FIG. 10). The other end of the spring 144 is anchored to the stationary member 34 of frame 30 through suitable ears 144*a*. The tension of the stretched spring causes strap 141 to exert an upward force on section 80.

Through the foregoing arrangements, the weight of frame assembly 25 is generally balanced, when the frame is in the retracted state. Initially, the foregoing arrangements urge frame assembly 25 to move toward an extended state. After the initial movement of frame assembly 25 toward the extension state, the foregoing arrangements do not further serve to move the articulated frame 25 toward the extension state.

In the exemplary embodiment of the present invention, the push rods 76 extended the respective legs 75 (FIGS. 4 and 5). In the preferred embodiment of the present invention, transversely spaced links 150 (FIG. 11) are used in lieu of the push rods 76 to extend the legs 75. The links 150 are pivotally connected to the links 181 at 150*a* and to the legs 75 at 150*b* respectively. When the links 181 are swung forwardly about the pivotal connection 81*a* by the forward and downward movement of section 57 assuming a generally horizontal position, the links 150 move downward from the position of FIG. 12 to the position of FIG. 11 to move the legs 175 to the upright position. A bracket 160 is fixed to the underside of section 180 and is provided with a pivot mounting 161. Bell crank 156 is pivotally mounted to the bracket at 161 and carries an arm 162 pivotally connected to push rod 157 at 158. The other free end of crank arm 156 is provided with a pivot mount 155. The modified floating power link 145 is pivotally connected at 80*a* to frame section 180 and is provided with an ear 163 having a pivot mounting 145*a* laterally offset from pivot 80*a*. The push rod 152 is connected to the two pivot mountings 145*a* and 155. In the fully retracted position of FIG. 12, the three pivots 80*a*, 145*a*, and 155 are essentially in alignment. As the floating power link 145 begins to rotate counter-clockwise at the initiation of the unfolding operation, pivot 145*a* moves almost at right angles to the axis of push rod 152 so that the distance between pivots 80*a* and 155 shortens very gradually and bell crank 156 rotates clockwise very slowly. As a consequence, pivot 158 swings clockwise very slowly and the distance between pivot 161 and pivot 79*b* decreases even more slowly. Thus, although all of the parts are linked together without lost motion and all are actuated simultaneously, the unfolding action is almost insignificant at the onset to allow the assembly to move out of the body cavity without interference. As the angle between the floating power link 145 and push rod 152 increases, rate of movement of push rod 152 increases rapidly, resulting in much more rapid unfolding of the components.

I claim:

1. A convertible article of furniture comprising:

a stationary frame having a storage cavity therein, a bed frame configured and adapted for storage in folded condition within the cavity and for extension in unfolded condition into a body-supporting bed frame in substantially horizontal position, and actuating mechanism for moving the assembly between its retracted and extended positions;

the stationary frame having a bottom, a pair of transversely spaced upright end walls, an upright rear wall extending transversely between and secured to the end walls, an upright back-cushion wall extending transversely between and secured to the end walls and spaced forwardly from the rear wall and terminating above the bottom of the frame, all of said walls having upper margins, and a low forward wall extending transversely between and secured to the end walls and terminating well below the upper margins of the other walls;

the bed frame assembly comprising a plurality of frame sections including at least a primary upper torso support section, a secondary lower torso support section, and a terminal leg support section, each section being generally rectangular in plan form and defined by two transversely spaced longitudinally extending frame members, having inner and outer ends, and pivotally connected to adjacent sections on transversely extending pivot axes;

the actuating mechanism comprising transversely spaced control and support linkages pivotally mounted at first ends to the stationary frame and pivotally connected at second ends to intermediate points on the frame members of the primary section, and transversely spaced floating power links having first and second ends and a midportion, each pivotally carried by a pair of control links pivotally connected at first ends to spaced locations on the stationary frame and pivotally connected at second ends to the first end and midportion of each floating power link to rotate and translate it in a vertical plane;

the second end of each floating power link being pivotally connected by a pivotal mount to the inner end of one of the frame members of the primary section, with the rotation and translation of the floating power link serving to translate the frame assembly out of and into the stationary frame about the control and support linkages;

and power means connected to the floating power links to drive them in their extension and retraction movements.

2. A convertible article of furniture as claimed in claim 1; in which a plurality of push rods including an innermost one located near the inner end of the primary frame section and having inner and outer ends and crank arms are mounted on several frame sections and are pivotally connected to each other to move in response to movements of the actuating mechanism to fold and unfold the frame sections continuously and progressively.

3. A convertible article of furniture as claimed in claim 2; in which the inner ends of the innermost push rods are pivotally connected to the floating power links at locations adjacent to the pivotal mounts connecting the inner ends of the primary frame sections to the floating power links.

4. A convertible article of furniture as claimed in claim 3; in which the power means to drive the floating power links includes cable means connected to both floating power links, trained over pulleys pivotally mounted on the frame, and arranged in a closed circuit to synchronize the movements of both floating power links.

5. A convertible article of furniture as claimed in claim 4; in which a reversible electric motor is connected to the cable means to cause it to move in both extension and retraction modes.

6. A convertible article of furniture as claimed in claim 1; in which a head support frame section is pivotally carried by the inner end of the primary frame section by means of limit stop pivot mounts, and its inner end is resiliently guided by flexible means in and out of the cavity behind the back-cushion wall.

7. A convertible article of furniture comprising:

a stationary frame;

an articulated bed frame assembly having a plurality of pivotally interconnected frame sections having laterally spaced sides and foldable into storage condition and unfoldable into extended body-supporting condition.

8. A convertible article of furniture as claimed in claim 7; in which the frame assembly includes at least a primary upper torso support section having inner and outer ends, a secondary lower torso support section, and a terminal leg support section;

a plurality of push rods including an innermost one located near the inner end of the primary frame section and having inner and outer ends, and crank arms are carried by the several sections and movably connected to each other by close fitting pivot connections to positively and continuously swing the sections through their folding and unfolding movements without lost motion or freeplay;

and the floating power links are similarly pivotally connected to the innermost push rods to positively drive all of the pushrods and crank arms in the folding and unfolding operations.

9. A convertible article of furniture as claimed in claim 8; in which the floating power links are generally elongate and are provided with first and second pivot mounts at each end portion and a third intermediate pivot mount offset laterally from the line between the first two pivot mounts;

a first control and guide link is pivotally connected at a first end to an elevated location on the stationary frame and at a second end to a first pivot mount at a first end of the floating power link, and a second control and guide link is pivotally connected at a first end to a lower location on the stationary frame and at a second end to the intermediate pivot mount on the floating power link, and the inner end of the innermost push rod is pivotally connected to the second end of the floating power link at a point spaced a short distance from the second pivot mount which is pivotally connected to the inner end of the primary section;

and the geometry of the control and guide links is chosen to cause the rotation and translation of the floating power links as they are driven in the extension and retraction directions.

10. A convertible article of furniture comprising:

a stationary frame formed with an upwardly open storage cavity to receive a folded bed frame assembly;

an articulated bed frame assembly having a plurality of pivotally interconnected frame sections, one of which is a primary section having inner and outer ends, configured and adapted for storage in folded condition within the cavity and for extension in unfolded condition into a body-supporting bed frame in substantially horizontal position;

actuating mechanism including transversely spaced control and support linkages pivotally mounted at first ends to the stationary frame and pivotally connected at second ends to intermediate points on the sides of the primary section;

the actuating mechanism further including transversely spaced floating power links pivotally connected to the inner end of the primary section;

and control links pivotally mounted at first ends to spaced locations on the stationary frame and pivotally connected at second ends to spaced locations on the floating power links to rotate and translate them in vertical planes and cause them to translate the frame assembly out of and into the cavity in the stationary frame;

and power means connected to the flowing power links to drive them in their extension and retraction movements.

11. A convertible article of furniture comprising:

a stationary frame;

an articulated bed frame assembly having a plurality of pivotally interconnected frame sections foldable into storage condition and unfoldable into extended body-supporting condition, the assembly including at least a primary upper torso support section, a secondary lower torso support section, and a terminal leg support section, each of said sections being generally rectangular in planform and defined by two transversely spaced longitudinally extending frame members having inner and outer ends and pivotally connected to adjacent sections on transversely extending pivot axes;

transversely spaced linkage members pivotally connecting the stationary frame and the primary frame section and movably supporting the assembly for rotation and translation between folded and unfolded condition during retraction and extension;

the secondary section being swingable through ninety degress about a transverse axis between a position at ninety degrees to the primary section and a position in alignment with the primary section;

the terminal section being swingable through ninety degrees through a transverse axis between a position at ninety degrees to the secondary section and overlying but spaced from the primary section and a position in alignment with the secondary section and the primary section to form a body-supporting horizontal framework;

a crank arm pivotally mounted on each side frame member of the primary section at an intermediate point in its length;

crank arms fixedly connected to the inner ends of the side frame members of the secondary section, and push rods pivotally connected to and extending between the crank arms on the primary section and the crank arms on the secondary section to cause the secondary section to swing through its ninety degree angle in response to longitudinal movement of the push rods;

crank arms fixedly connected to the inner ends of the side frame members of the terminal section, and push rods pivotally connected to and extending between crank arms at the juncture of the primary and secondary sections and the crank arms on the terminal section to cause the terminal section to swing through its ninety degree angle in response to longitudinal movements of its associated push rods;

additional push rods pivotally connected to and extending between the first-mentioned crank arms and selected elements of the linkage members supporting the assembly for rotation and translation, the selected elements being adapted to move the additional push rods longitudinally with respect to the primary section during extension and retraction and produce continuous and progressive folding and unfolding action of the frame sections;

and power means connected to the selected elements to drive them in their extension and retraction movements.

12. The apparatus as claimed in claim 11, in which the selected elements of the linkage members are floating power links;

and control links are pivotally mounted at first ends to spaced locations on the stationary frame and pivotally connected at second ends to spaced locations on the floating power links to rotate and translate them in vertical planes and cause them to translate the frame assembly in extension and retraction.

13. The apparatus as claimed in claim 12, in which;

the power means to drive the floating power links includes cable means connected to both floating power links and arranged in a closed circuit to synchronize the movement of both floating power links.

14. The apparatus as claimed in claim 13, in which;

a reversible electric motor is connected to the cable means to cause it to move in both extension and retraction modes.

15. The apparatus as claimed in claim 14, in which;

a key-operated switch is provided to control the power to the motor, the key being operable in clockwise and counter-clockwise directions to determine the direction of rotation of the motor and being removable from the switch to prevent unauthorized actuation of the apparatus.

16. The apparatus as claimed in claim 14, in which;

limit stop switches are connected to the electric motor to interrupt the flow of current thereto when the cable means reaches a preselected limit of travel in either direction.

17. The apparatus as claimed in claim 14, in which; limit stop switches are connected to the electric motor to interrupt the flow of current thereto in response to the imposition of a limit load on the motor by the cable means in the course of its travel in either direction.

18. A convertible article of furniture comprising:

(a) a stationary frame;

(b) an articulated frame pivotally connected to said stationary frame, said articulated frame comprising:

1. at least three pivotally connected sections, and 2. a floating power link;

(c) means connected to said floating power link for imparting a pivotal movement to said floating power link for extending and retracting said section, and (d) a series of links and pivot points interconnecting each of said three said sections, said series of links and pivot points being driven by said same floating power link to continuously and progressively extend and retract each of said pivotally connected sections relative to each other using said same power link.

19. A convertible article of furniture as claimed in claim 18 wherein said means comprises cable means connected to said floating power link for applying an extension directed force thereto for extending progressively said sections of said articulated frame and for applying a retraction directed force thereto for retracting progressively said sections of said articulated frame.

20. A convertible article of furniture comprising:

(a) a stationary frame;

(b) an articulated frame pivotally connected to said stationary frame, said articulated frame comprising a plurality of pivotally connected foldable sections; and (c) cable drive means connected to said articulated frame for applying an extension directed force to said articulated frame to continuously and progressively extend said sections of said articulated frame wherein each of said sections is unfolded and for applying a retraction directed force to said articulated frame to continuously and progressivley retract said sections to said articulated frame wherein each of said sections is folded.

21. A convertible article of furniture as claimed in claim 20 wherein said articulated frame comprises a floating power link for extending said sections in response to the application of the extension directed force by said cable drive means and for retracting said sections in response to the application of the retraction directed force by said cable drive means.

22. A convertible article of furniture as claimed in claim 21 wherein the application of said extension directed force imparts a pivotal movement to said floating power link in one direction and the application of said retraction directed force to said floating power link imparts a pivotal movement to said floating power link in an opposite direction.

23. A convertible article of furniture as claimed in claim 22 wherein said floating power link has a plurality of angularly spaced pivot points, and said cable drive means applies the extension directed force and the retraction directed force to one of said pivot points for imparting pivotal movement about another of said pivot points.

* * * * *